US010371026B2

(12) United States Patent
Tokunaga et al.

(10) Patent No.: US 10,371,026 B2
(45) Date of Patent: Aug. 6, 2019

(54) BLOW-BY GAS RETURN STRUCTURE

(71) Applicant: KUBOTA Corporation, Osaka-shi, Osaka (JP)

(72) Inventors: Takahiro Tokunaga, Sakai (JP); Yusuke Tanimoto, Sakai (JP); Kazuya Hamada, Sakai (JP); Shinji Kishi, Sakai (JP); Yuzo Umeda, Sakai (JP)

(73) Assignee: KUBOTA Corporation, Osaka-shi, Osaka (JP)

( * ) Notice: Subject to any disclaimer, the term of this patent is extended or adjusted under 35 U.S.C. 154(b) by 229 days.

(21) Appl. No.: 15/618,323

(22) Filed: Jun. 9, 2017

(65) Prior Publication Data

US 2017/0370256 A1 Dec. 28, 2017

(30) Foreign Application Priority Data

Jun. 28, 2016 (JP) ..... 2016-127909

(51) Int. Cl.
*F01M 13/04* (2006.01)
*F01M 13/00* (2006.01)
*F01P 3/12* (2006.01)

(52) U.S. Cl.
CPC ..... *F01M 13/00* (2013.01); *F01M 13/04* (2013.01); *F01P 3/12* (2013.01); *F01M 2013/0411* (2013.01); *F01M 2013/0472* (2013.01); *F01M 2013/0488* (2013.01)

(58) Field of Classification Search
CPC ..... F01M 13/00; F01M 13/04; F01M 2013/0411; F01M 2013/0488; F01M 2013/0472; F01P 3/12
See application file for complete search history.

(56) References Cited

U.S. PATENT DOCUMENTS 4,667,647 A * 5/1987 Ohtaka ..... F01M 5/001 123/573
4,768,493 A * 9/1988 Ohtaka ..... F01M 13/00 123/545
5,285,754 A * 2/1994 Bell ..... F01M 13/0416 123/195 C
10,066,523 B2 * 9/2018 Okazaki ..... F01M 13/04
(Continued)

FOREIGN PATENT DOCUMENTS

JP 2008163837 A 7/2008

*Primary Examiner* — Thomas N Moulis
(74) *Attorney, Agent, or Firm* — Panitch Schwarze Belisario & Nadel LLP

(57) ABSTRACT

An improved blow-by gas return structure minimizes the occurrence of a drawback caused by freezing at a low temperature by bringing a state where freezing minimally occurs in a blow-bay gas passage such as a pipe disposed outside an engine. The blow-by gas return structure is configured such that a blow-by gas is introduced into an intake manifold through an inner passage formed in a head cover. The blow-by gas return structure includes an outer pipe which connects a blow-by gas outlet of the head cover and a blow-by gas inlet of a main pipe of the intake manifold in a communicable manner, and a temperature elevating mechanism configured to elevate a temperature of the blow-by gas inlet. The temperature elevating mechanism is configured such that a cooling water transfer passage is formed in a portion of the blow-by gas inlet of the main pipe.

14 Claims, 13 Drawing Sheets

(56) References Cited

U.S. PATENT DOCUMENTS

| | | | | |
|---|---|---|---|---|
| 2007/0186913 | A1* | 8/2007 | Ideguchi | F01M 13/04 123/574 |
| 2008/0092864 | A1* | 4/2008 | Suzuki | F01M 13/023 123/574 |
| 2010/0313561 | A1* | 12/2010 | Niwa | B60K 13/04 60/602 |
| 2015/0226097 | A1* | 8/2015 | Hasegawa | F01M 13/0011 123/574 |
| 2016/0047283 | A1* | 2/2016 | Newman | F01M 13/028 123/574 |
| 2018/0051605 | A1* | 2/2018 | Stack | F01M 13/00 |
| 2018/0171946 | A1* | 6/2018 | Furukawa | F01M 13/0405 |
| 2019/0003357 | A1* | 1/2019 | Isoshima | F01M 13/04 |
| 2019/0017420 | A1* | 1/2019 | Kashiwabara | F01M 13/04 |

* cited by examiner

BLOW-BY GAS RETURN STRUCTURE

BACKGROUND OF THE INVENTION

(1) Field of the Invention

The present invention relates to a blow-by-gas return structure.

(2) Description of Related Art

As a conventional blow-by gas return structure, there has been adopted a structure where a blow-by gas which leaks out to a crankcase is made to return to an intake passage through an arrangement passage of an operating valve mechanism, a supply hole for a lubricant, and a head cover.

SUMMARY OF THE INVENTION

In general, a pipe through which a blow-by gas returns to an intake passage is exposed to the outside of an engine and hence, there is a tendency that the pipe has a low tolerance for cold. In an extremely low temperature state, a blow-by gas which returns to the intake passage is cooled by fresh air in the intake passage so that moisture in the blow-by gas is frozen at a pipe outlet portion thus giving rise to a drawback that the pipe is clogged.

An object of the present invention is to provide a blow-by gas return structure which is improved so as to minimize the occurrence of the above-mentioned drawback caused by freezing at a low temperature by bringing a state where freezing minimally occurs in an intake-passage-side end portion of a blow-bay gas passage, with structural improvement.

According to one aspect of the present invention, there is provided a blow-by gas return structure configured such that a brow-by gas in a crankcase is introduced into an intake passage through a cover inner passage formed in a head cover, wherein the blow-by gas return structure includes: a pipe which connects a blow-by gas outlet of the head cover and a blow-by gas inlet of the intake passage in a communicable manner; and a temperature elevating mechanism configured to elevate a temperature of the blow-by gas inlet.

According to the present invention, even when moisture in a blow-by gas which flows in the pipe is frozen at a pipe outlet portion due to an extremely low-temperature state, a temperature of the blow-by gas inlet which is a pipe outlet side portion can be elevated by a temperature elevating mechanism.

For example, even in an extremely low-temperature state, by effectively making use of engine heat using cooling water, it is possible to bring the pipe outlet portion into a state where the pipe outlet portion is minimally frozen so that the blow-by gas return structure can be improved such that the above-mentioned drawback which may be caused by freezing at a low temperature can be minimized.

BRIEF DESCRIPTION OF THE DRAWINGS

FIG. 12A is an enlarged perspective view showing a main part of an intake manifold, and FIG. 12B is a cross-sectional view of a main part showing a transfer passage for cooling water.

DETAILED DESCRIPTION OF PREFERRED EMBODIMENTS

Figure 1:
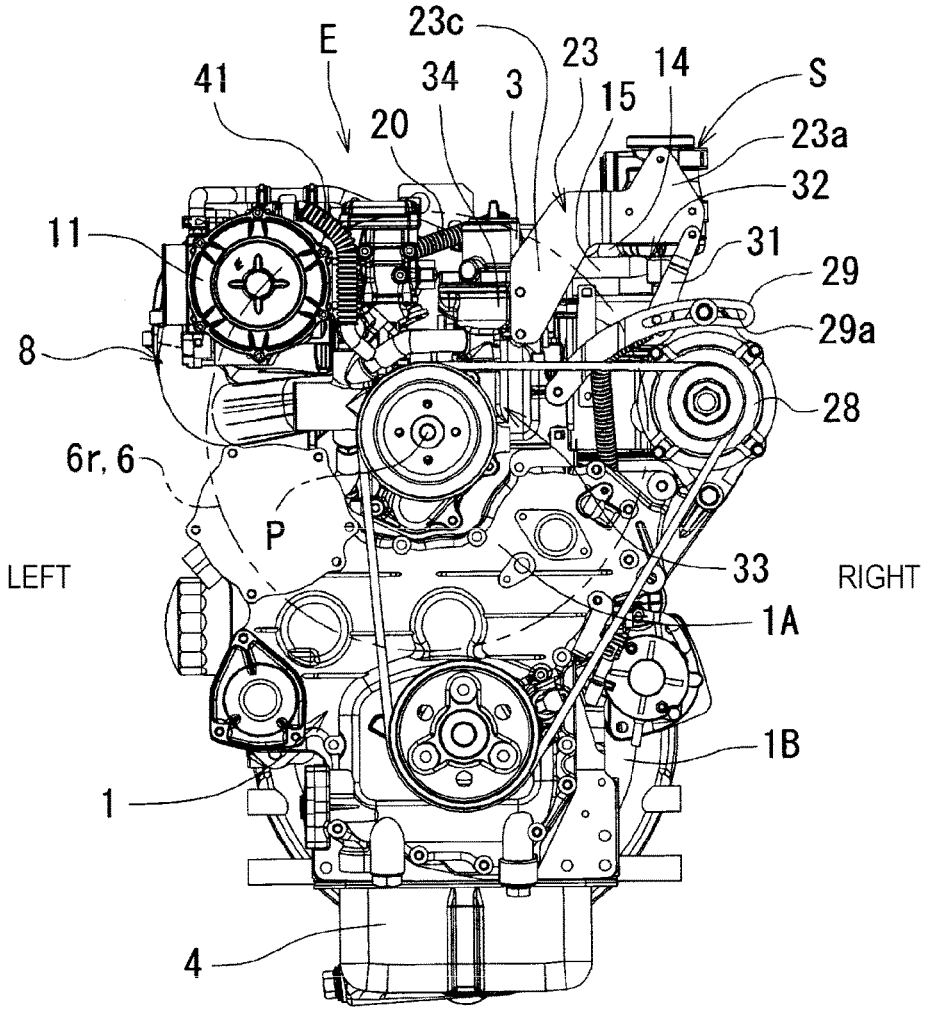
FIG. 1 is a front view showing an industrial engine.
Figure 2:
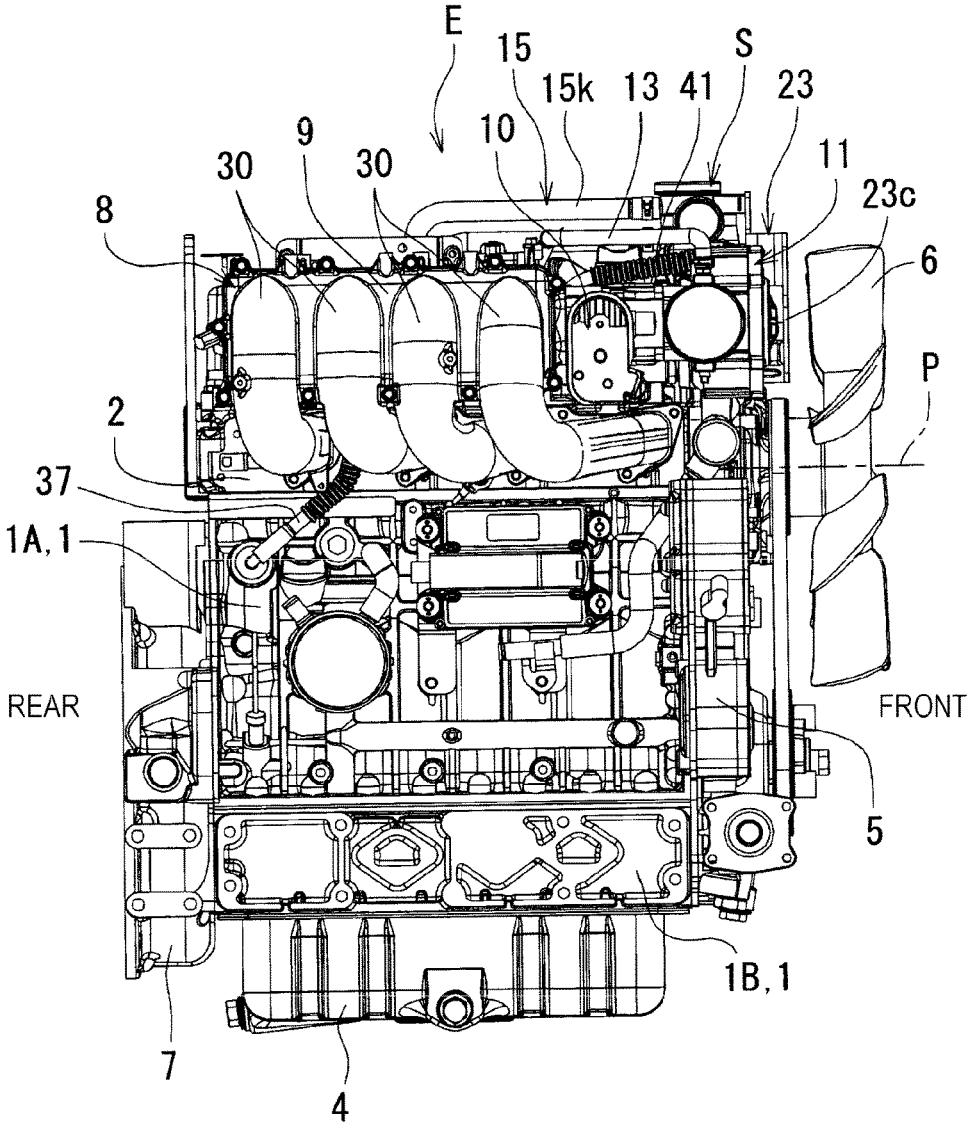
FIG. 2 is a left side view of the engine shown in FIG. 1.

Hereinafter, an engine having a blow-by gas return structure according to an embodiment of the present invention is described with reference to drawings by taking a vertical spark ignition and straight multiple cylinder type industrial engine used in a tractor for agriculture as one example. In the description made hereinafter, a side where an engine cooling fan 6 is provided in a crankshaft direction is assumed as a front side, a side opposite to the front side is assumed as a rear side, an intake manifold 8 side is assumed as a left side, and an exhaust manifold 25 side is assumed as a right side.

As shown in FIG. 1 to FIG. 5, the engine is configured such that a cylinder head 2 is assembled to an upper portion of a cylinder block 1, a cylinder head cover (hereinafter simply referred to as a head cover) 3 is assembled to an upper portion of the cylinder head 2, and an oil pan 4 is assembled to a lower portion of the cylinder block 1. A transmission case 5 is assembled to a front end portion of the cylinder block 1, the engine cooling fan 6 is disposed on a front portion of the transmission case 5, and a flywheel or a flywheel housing 7 is disposed on a rear portion of the cylinder block 1. An upper half portion of the cylinder block 1 forms a cylinder portion 1A, and a lower half portion of the cylinder block 1 forms a crankcase 1B.

An intake manifold 8 is disposed on one lateral side of the cylinder head 2, for example, on a left side of the cylinder head 2. A throttle valve 10 is mounted on a front portion of a main pipe 9 of the intake manifold 8. A gas mixer 11 is mounted on a front portion of the throttle valve 10. An air cleaner (not shown in the drawing) is communicated with the gas mixer 11. The main pipe 9 of the intake manifold 8 is a pipe having a quadrangular prism shape elongated in a longitudinal direction which is an extending direction of an axis P of the crankshaft, for example. Branch pipes 30, the number of which corresponds to the number of cylinders (four) are branched from the main pipe 9 so as to distribute intake air into intake ports of the respective cylinders. Symbol 28 indicates an alternator, and symbol 29 indicates an adjusting arm for adjusting a position of the alternator.

Figure 5:
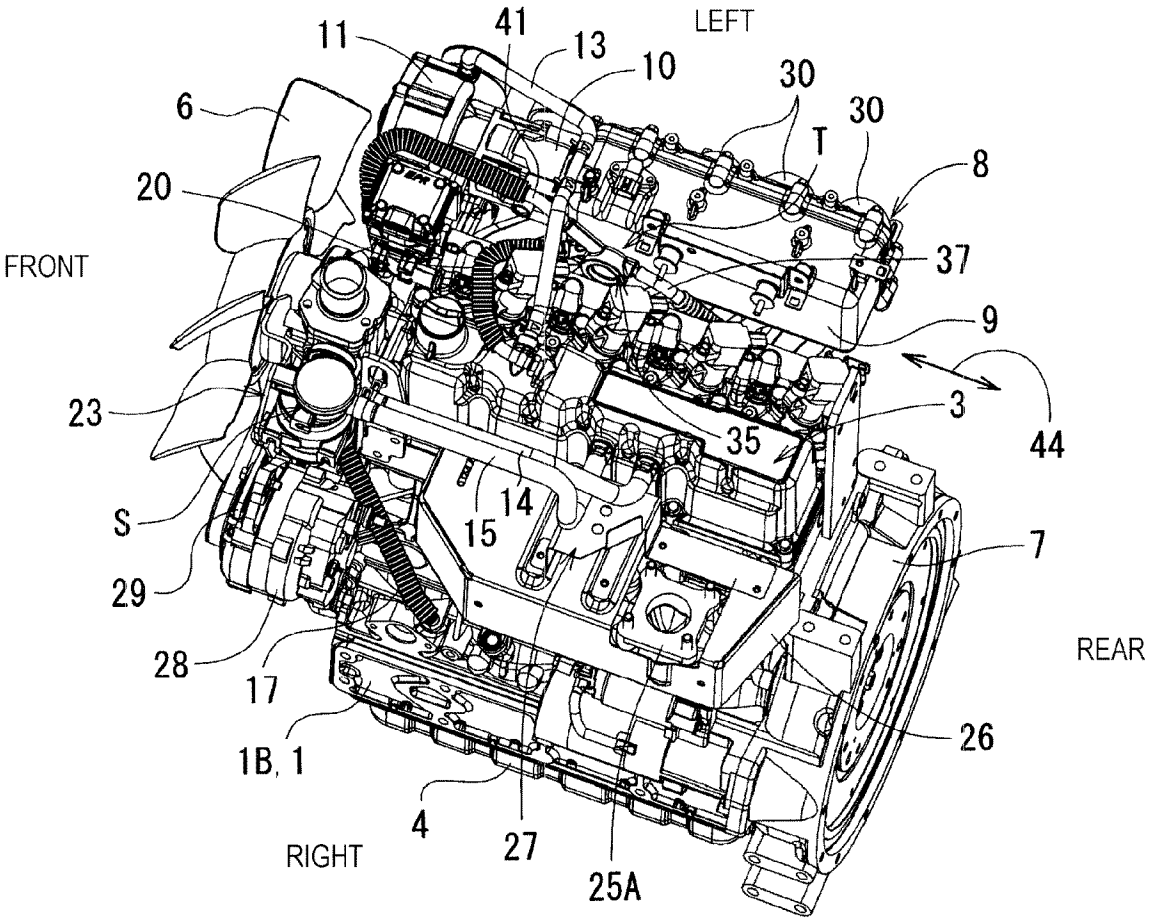
FIG. 5 is an entire perspective view of the engine shown in FIG. 1 as viewed from a right and rear oblique upper side.
Figure 11:
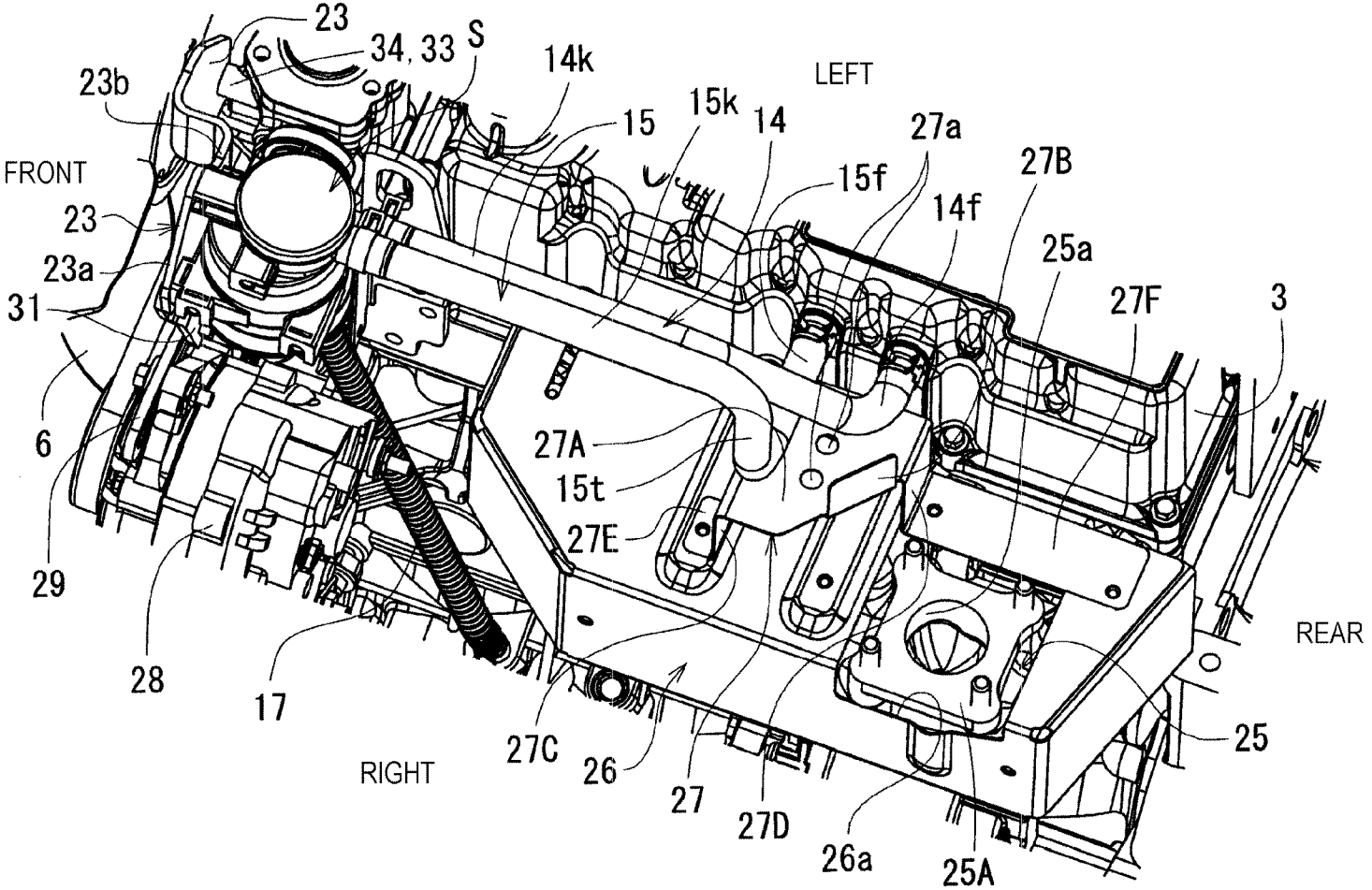
FIG. 11 is a perspective view of a main part showing an exhaust manifold and an area in the vicinity of the exhaust manifold as viewed from a right and rear oblique upper side.

As shown in FIG. 5 and FIG. 11, an exhaust manifold 25 and an exhaust cover 26 which covers the exhaust manifold 25 are disposed on one lateral side of the cylinder head 2, for example, a right side of the cylinder head 2. A single exhaust flange 25A having an upward outlet opening 25*a* of the exhaust manifold 25 is provided, and the exhaust flange 25A is positioned on an opening portion 26*a* having a notched shape of the exhaust cover 26. The opening portion 26*a* is formed on an upper surface side of a rear portion of the exhaust cover 26.

Figure 3:
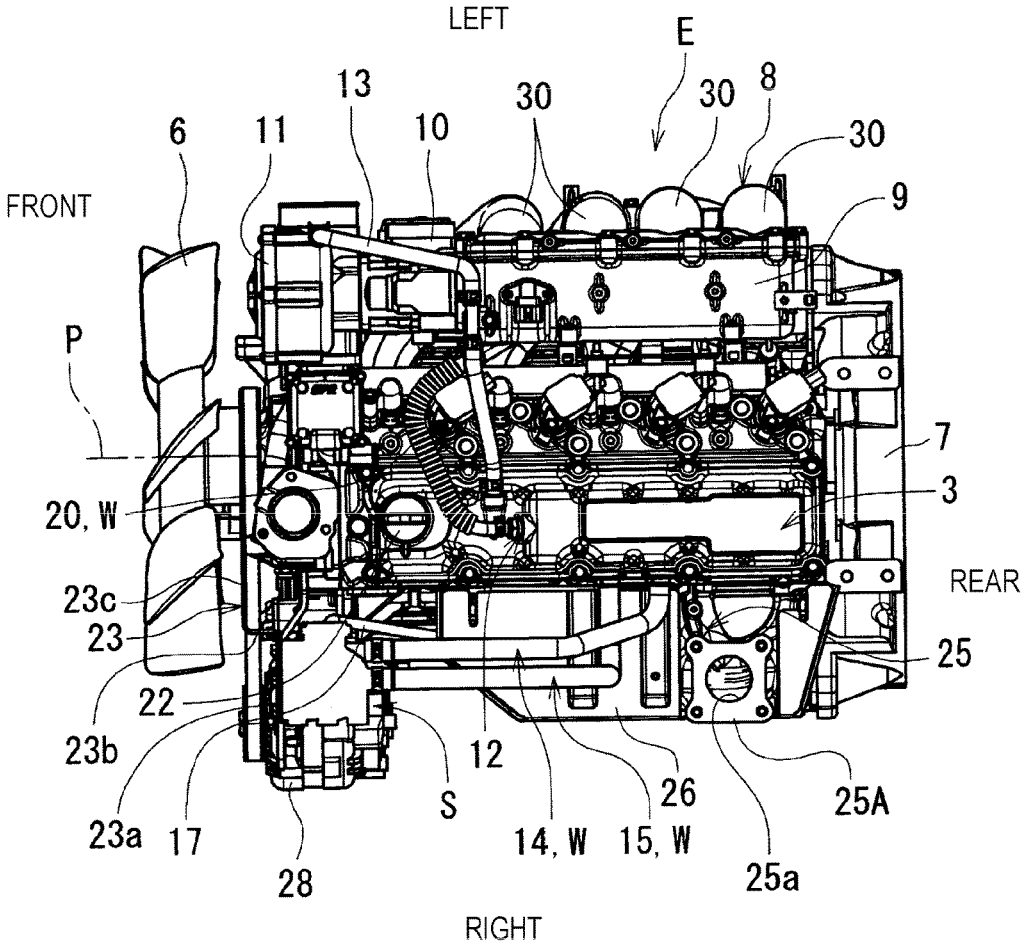
FIG. 3 is a plan view of the engine shown in FIG. 1.

As shown in FIG. 3 and FIG. 5, a PCV valve (one example of a blow-by gas outlet) 12 is integrally mounted on an upper portion of the head cover 3, and the main pipe 9 of the intake manifold 8 which forms a passage downstream of the throttle valve 10 in an air supply passage and the PCV valve 12 are connected to each other in a communicable manner through a pipe 20 for a blow-by gas. Further, the gas mixer 11 and an upper portion of the head cover 3 are connected to each other in a communicable manner through a fresh air introducing tube 13. The intake manifold 8 and the main pipe 9 form one example of the intake passage.

Figure 6:
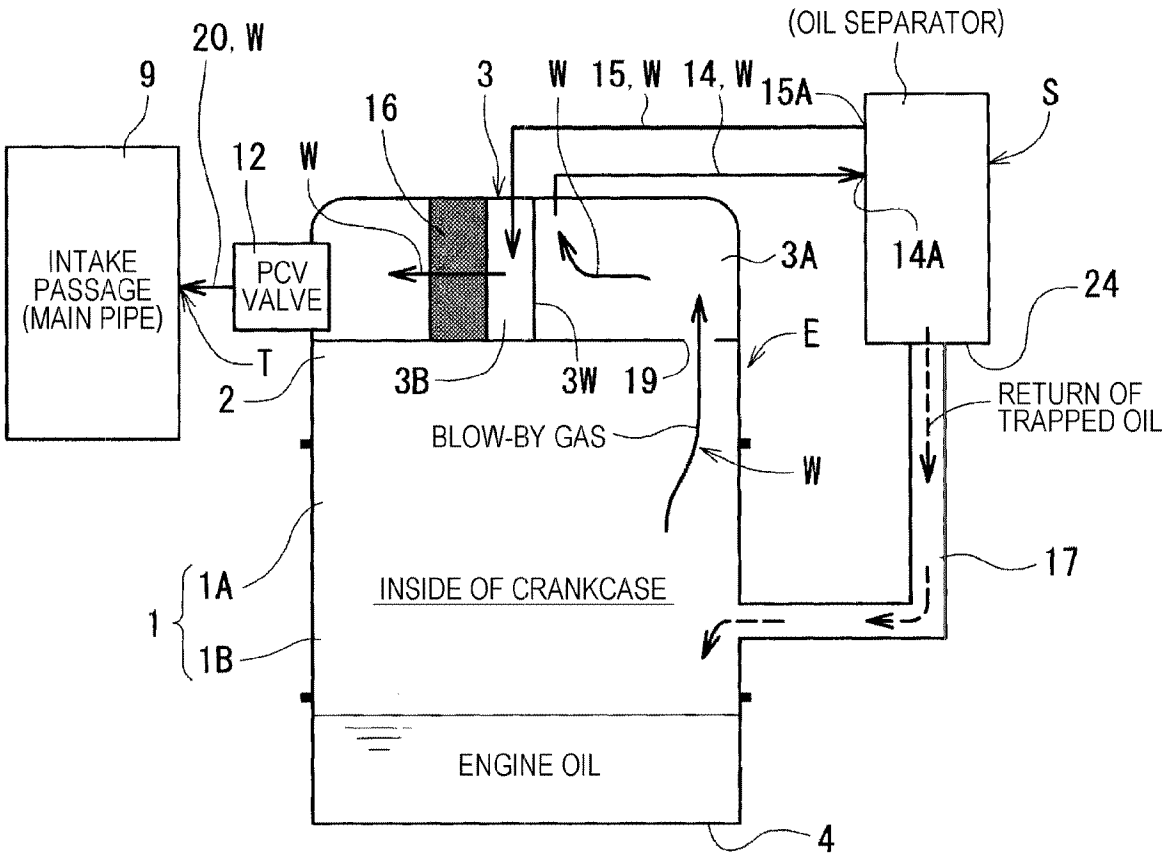
FIG. 6 is a schematic view schematically showing a blow-by gas return structure.

Next, the blow-by gas return structure in the engine is described. As shown in FIG. 6, the engine E is provided with a blow-by gas passage W which can guide a blow-by gas in a crankcase 1B to a passage downstream of the throttle valve 10 from the inside of the head cover 3 through the PCV valve 12. The blow-by gas passage W is formed of respective passages through which a blow-by gas generated in the crankcase 1B is made to return to the main pipe 9. That is, a blow-by gas is made to return to the main pipe 9 through the inside of the head cover 3, an external oil separator S, the inside of the head cover 3, and the PCV valve 12 in this order.

As shown in FIG. 6, the inside of the head cover 3 is partitioned into a cover one-end-side chamber 3A which communicates with the inside of the crankcase 1B, and a cover other-end-side chamber 3B which communicates with the PCV valve 12, by a partition wall 3W. The oil separator S (see FIG. 5, FIG. 10 and the like) which has a gas inlet 14A which communicates with the cover one-end-side chamber 3A and a gas outlet 15A which communicates with the cover other-end-side chamber 3B is provided as a part separate from the head cover 3 with the use of a pair of supply/exhaust pipes 14, 15.

In this embodiment, the cover one-end-side chamber 3A (one example of the cover inner passage) is a portion of the inside of the head cover 3. The cover one-end-side chamber 3A is disposed on a flywheel housing 7 side (rear side) in a direction of a crank axis (not indicated by a symbol) which is an axis of the flywheel. The cover other-end-side chamber 3B (one example of the cover inner passage) is also a portion of the inside of the head cover 3. The cover other-end-side chamber 3B is disposed on an engine cooling fan 6 side (front side) in the direction of the crank axis (not indicated by a symbol). The crank axis (not indicated by a symbol) extends parallel to an axis P of the engine cooling fan 6 described later.

A filter 16 which is used for trapping and removing engine oil from a blow-by gas is disposed on a downstream side of a communicating portion of the cover other-end-side chamber 3B which communicates with the oil separator S in a blow-by gas flowing direction. The engine also includes an oil return passage 17 made of a tube, and oil trapped by the oil separator S is made to return to the inside of the crankcase 1B through the oil return passage 17.

Figure 7:
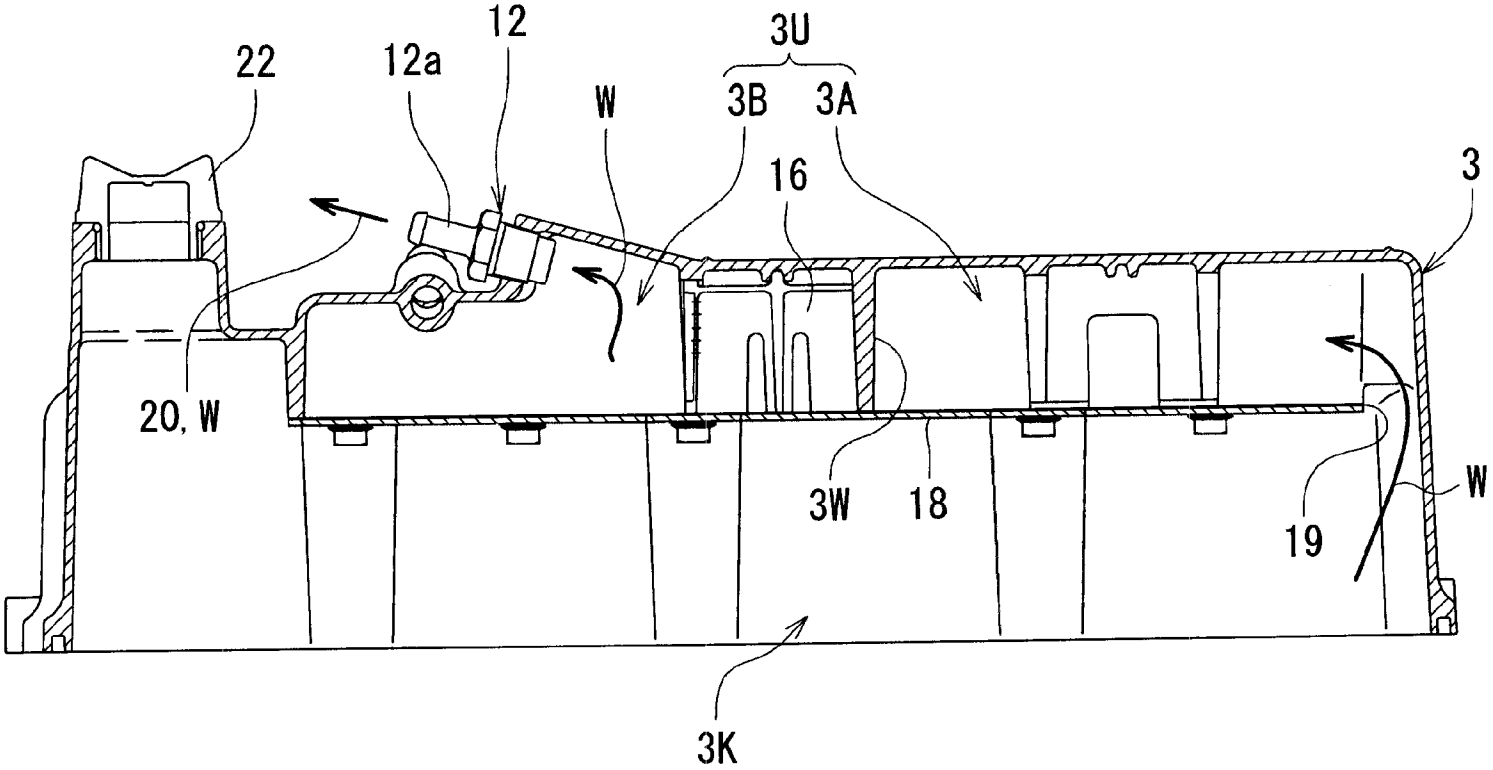
FIG. 7 is a partially-cutaway side view of a cylinder head cover.
Figure 8:
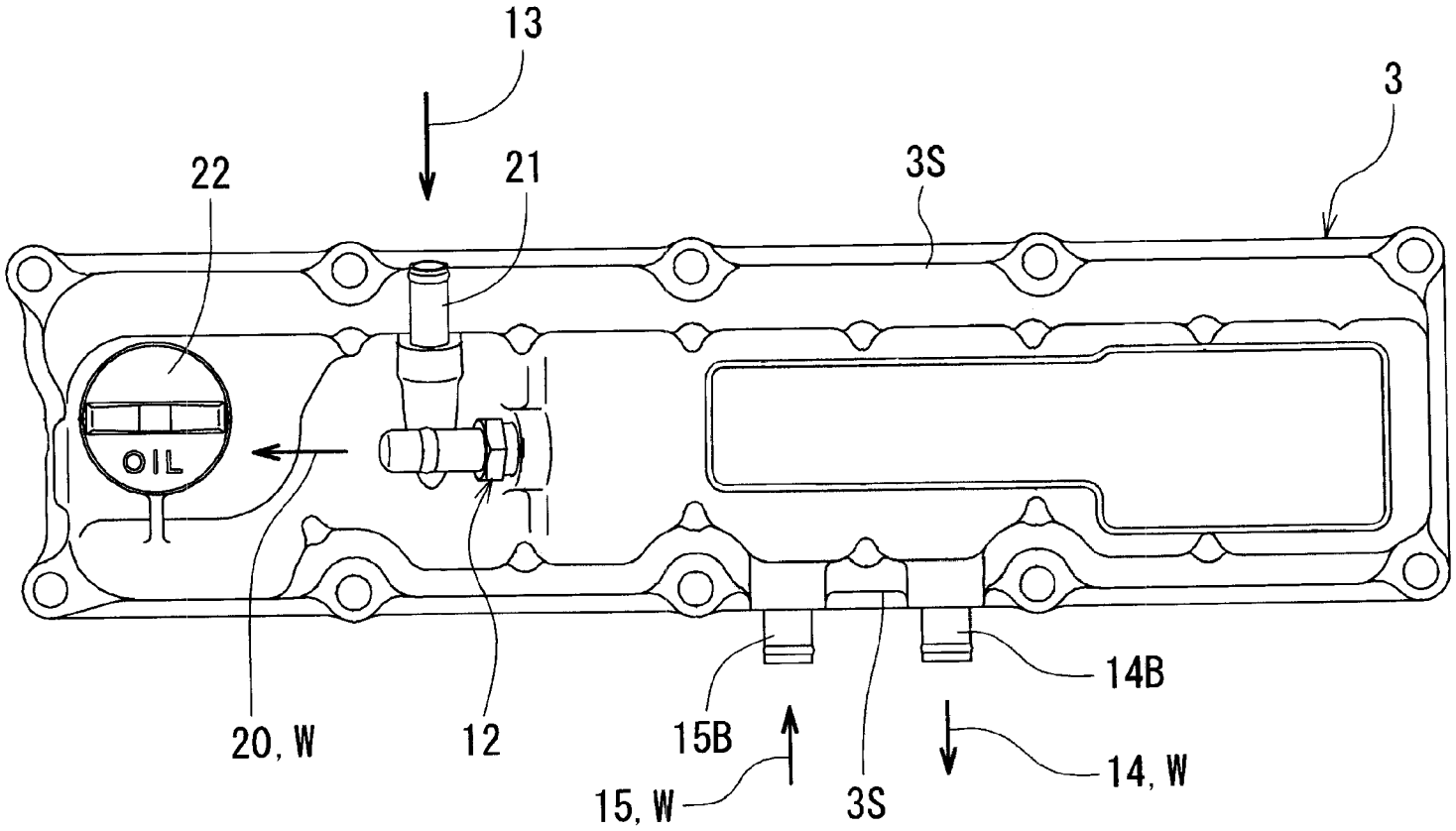
FIG. 8 is a plan view of the cylinder head cover.
Figure 9:
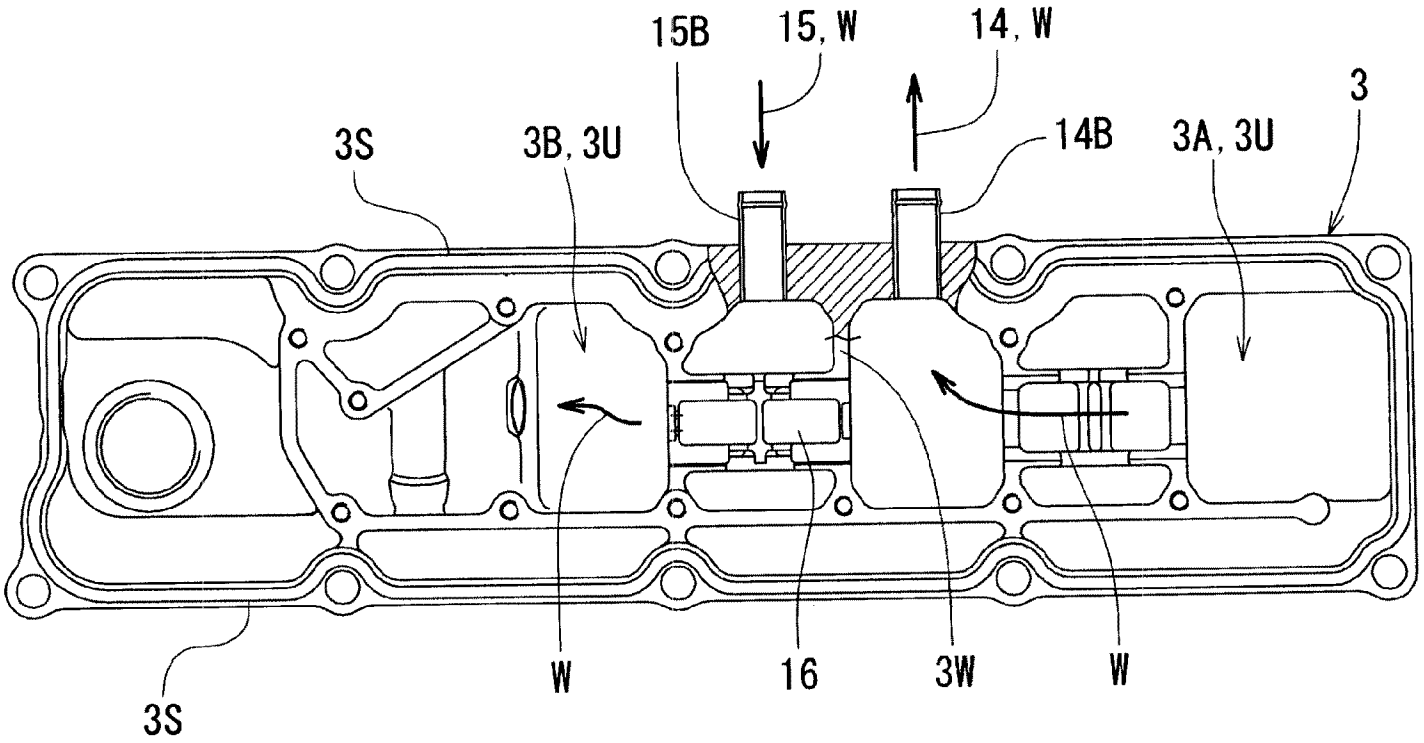
FIG. 9 is a partially-cutaway bottom view of the cylinder head cover.

As shown in FIG. 7 to FIG. 9, the head cover 3 has a bottomless box shape and is integrally disposed on an upper portion of the cylinder head 2. A cover inner space of the head cover 3 is partitioned into a lower space 3K and an upper space 3U by a horizontally extending partition plate 18 which is fixed to the head cover 3 by bolts. The lower space 3K and the upper space 3U are communicated with each other only through a cutout portion 19 which is formed on a flywheel housing 7 side end of the horizontally extending partition plate 18.

The upper space 3U is partitioned into the cover one-end-side chamber 3A having the cutout portion 19 and the cover other-end-side chamber 3B having the PCV valve 12 by the partition wall 3W positioned at an intermediate portion of the head cover 3 in a longitudinal direction of the head cover 3. The partition wall 3W also functions as a structural portion for setting the filter 16 for removing mist-like engine oil from a blow-by gas. The PCV valve 12 is disposed on a downstream side of the oil separator S in the blow-by gas flowing direction in the cover inner passages 3A, 3B.

As shown in FIG. 6, FIG. 7 and FIG. 9, a gas take-out port 14B formed of a pipe member is formed on a side wall 3S of the head cover 3 near the partition wall 3W in the cover one-end-side chamber 3A. A supply/exhaust pipe 14 on a supply side is connected to the gas take-out port 14B. A gas return port 15B which is formed of a pipe member is formed on the side wall 3S of the head cover 3 near the partition wall 3W in the cover other-end-side chamber 3B. A supply/exhaust pipe 15 on a discharge side is connected to the gas return port 15B.

As shown in FIG. 3, FIG. 6 to FIG. 8, the PCV valve 12 which communicates with the upper portion of the cover other-end-side chamber 3B is integrally formed on the head cover 3 by using a tapered screw or the like. The PCV valve 12 is disposed in a posture where the PCV valve 12 extends in a longitudinal direction of the head cover 3 and an exhaust-side pipe 12*a* of the PCV valve 12 is directed outward and obliquely upward. A connection pipe 21 to which the fresh air introducing tube 13 is connected by fitting is mounted on a portion of the head cover 3 below the exhaust-side pipe 12*a* in a posture where the connection pipe 21 intersects with the PCV valve 12 and is directed obliquely upward. In this specification, symbol 22 indicates a cap which is threadedly mounted on an engine oil supply port.

As shown in FIG. 1, FIG. 3 to FIG. 5, FIG. 10 and FIG. 11, the oil separator S is provided to an end portion of the head cover 3 which is on an engine cooling fan side in the longitudinal direction of the head cover 3 as an independent component disposed on an exhaust manifold 25 side with respect to the head cover 3 at a height slightly higher than the head cover 3 using a sheet-metal-made mounting bracket 23. The supply-side supply/exhaust pipe 14 which is connected to the cover inner passage 3A in a communicable manner is led out to a side of an upper end portion of the oil separator S, and the exhaust-side supply/exhaust pipe 15 which is connected to the cover inner passage 3B in a communicable manner is led out to an area directly below the supply-side supply/exhaust pipe 14.

That is, the oil separator S which is externally mounted on the engine is mounted on an exhaust side (right side) of the cylinder head 2 at a position higher than the head cover 3 such that both the pair of supply/exhaust pipes 14, 15 are not inclined so as to prevent a head cover side from becoming higher than an oil separator S side and the head cover 3 side becomes lower than the oil separator S side. The oil separator S is disposed close to the engine cooling fan 6 outside a rotational region of the engine cooling fan 6 as viewed in a direction of the axis P of the engine cooling fan 6 and on a leeward side of the engine cooling fan 6. The oil separator S is disposed behind (on a leeward side) of the engine cooling fan 6. The oil separator S is disposed more on a front side (engine cooling fan 6 side) than the exhaust manifold 25 (exhaust cover 26). The oil separator S is also disposed closer to the engine cooling fan 6 than the exhaust manifold 25 (exhaust cover 26) in the longitudinal direction.

Mounting structure of the oil separator S is described in detail. As shown in FIG. 1 to FIG. 3, FIG. 10 and FIG. 11, the mounting bracket 23 is formed of: a distal-end windproof portion 23*a* which supports the oil separator S from a front side using bolts; a proximal end portion 23*c* which is disposed on an engine cooling fan side (front side) of the cylinder head 2 and is fixed by bolts to a front wall of a water flange 34 which houses a thermostat therein; and an intermediate portion 23*b* which connects the windproof portion 23*a* and the proximal end portion 23*c* to each other. To arrange the oil separator S as close as possible to the engine cooling fan 6 in the longitudinal direction, it is rational that the mounting bracket 23 for the oil separator S is fixed by bolts to the water flange 34 disposed at a position in front of the cylinder head 2 (head cover 3). A cooling water pump 33 is disposed behind the engine cooling fan 6.

The windproof portion 23*a* has a size and a shape sufficient for covering almost all projection area of the oil separator S while having an upwardly projecting triangular portion as viewed in a front view. With such a configuration, the windproof portion 23*a* substantially prevents cooling air from affecting the oil separator S. The proximal end portion 23*c* has an oblique rightward and upward raised shape so as to elevate the windproof portion 23*a* thus making the oil separator S disposed at a higher position than the head cover 3. The intermediate portion 23*b* connects both the windproof portion 23*a* and the proximal end portion 23*c* to each other in a longitudinally directed posture such that the windproof portion 23*a* is positioned behind the proximal end portion 23*c* between the windproof portion 23*a* and the proximal end portion 23*c* which are disposed along a lateral direction.

The alternator 28 is fixed to an adjusting arm 29 having a curved shape which is pivotally supported on an engine such as a cylinder head 2 in a positionally adjustable manner using a circular arcuate elongated hole 29*a* formed in the adjusting arm 29 so as to enable adjustment of tension of a belt (fan belt: not shown in the drawing). The adjusting arm 29 is formed of a steel plate having a large thickness, and is excellent in strength.

A distal end portion of the mounting bracket 23 and the adjusting arm 29 are connected and fixed to each other by a connecting member 31 having one end thereof fixed to the circular arcuate elongated hole 29*a* of the adjusting arm 29 using a bolt, and has the other end thereof fixed to a lower portion of the windproof portion 23*a* using a bolt. The connecting member 31 is connected to a proximal end side of the long circular arcuate elongated hole 29*a* extending in an adjusting direction and hence, the connecting member 31 can be used also as a strength member without causing obstacle in a function of adjusting the alternator 28.

Since the oil separator S is lifted up by the mounting bracket 23, a flowing passage 32 for cooling air from the engine cooling fan 6 is formed between the oil separator S and the alternator 28 disposed below the oil separator S. More specifically, almost all portion of the flowing passage 32 is a space portion surrounded by the mounting bracket 23, the adjusting arm 29, and the connecting member 31.

That is, the distal end portion of the mounting bracket 23 and the adjusting arm 29 which enables adjustment and setting of a belt tensioning position of the alternator 28 are connected and fixed to each other using the sheet-metal-made connecting member 31, and on the mounting bracket 23, the windproof portion 23*a* which restricts impingement of cooling air from the engine cooling fan 6 on the oil separator S is formed. Arrangement of the mounting bracket 23 is set such that the cooling air flowing passage 32 can be ensured below the oil separator S.

An oil return passage 17 through which an engine oil trapped in the oil separator S is made to return to the crankcase 1B using a tube is connected to a bottom portion (or a bottom wall) 24 of the oil separator S in a communicable manner. Although not shown in the drawing, a filter which separates mist-like engine oil mixed into a blow-by gas is disposed in the inside of the oil separator S. Engine oil trapped by the filter returns to the inside of the crankcase 1B through the previously-mentioned oil return passage 17 by free fall due to the gravity.

Figure 4:
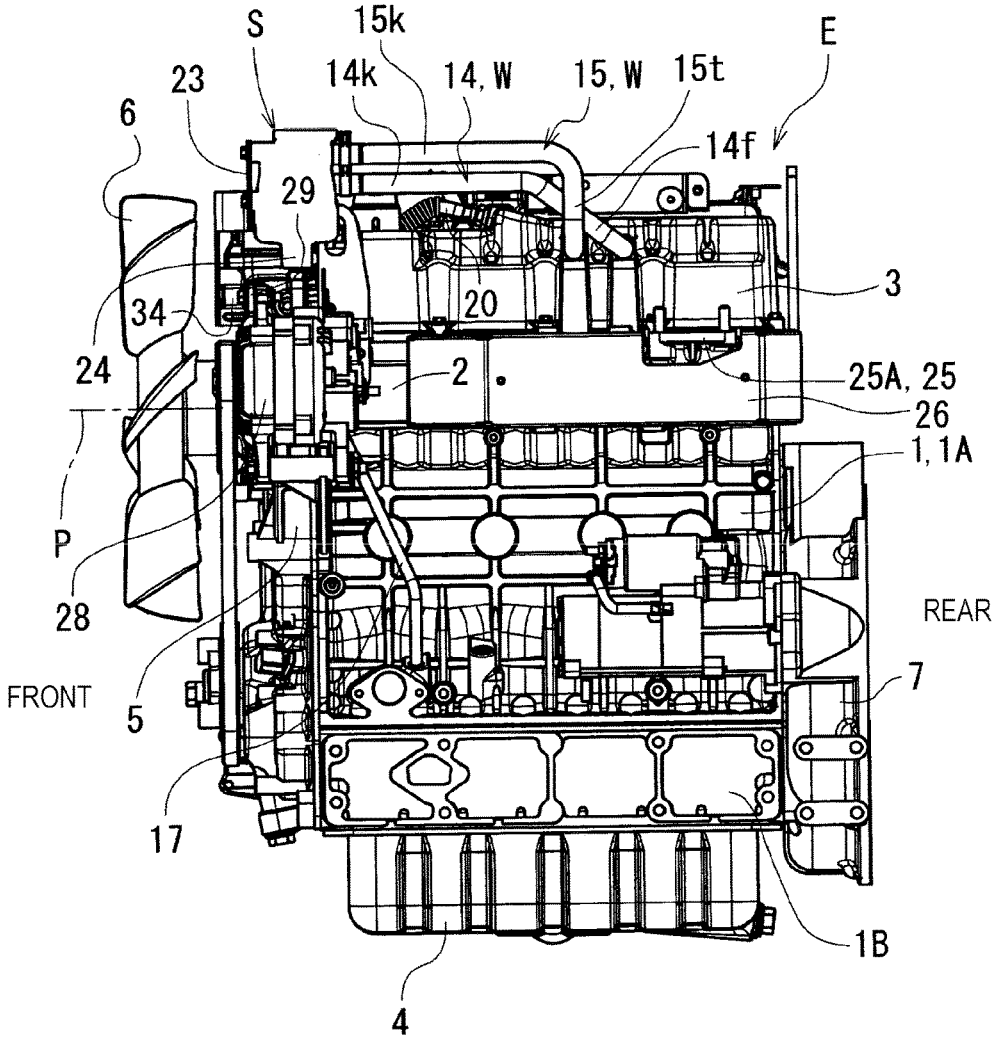
FIG. 4 is a right side view of the engine shown in FIG. 1.

As shown in FIG. 3 to FIG. 5, the supply-side supply/exhaust pipe 14 has: a supply pipe proximal end portion 14*f* which has an approximately L shape and is connected by fitting to the gas take-out port 14B in a state where the supply pipe proximal end portion 14*f* is inclined such that an oil separator side becomes higher than a side opposite to the oil separator side; and a supply pipe distal end portion 14*k* which has a linear shape and is connected by fitting to the gas inlet 14A in a horizontal posture. Accordingly, when the supply-side supply/exhaust pipe 14 is viewed as a whole, the supply-side supply/exhaust pipe 14 is arranged in a posture where a head cover 3 side is lower than an oil separator S side.

As shown in FIG. 3 to FIG. 5 and FIG. 11, the exhaust-side supply/exhaust pipe 15 has: an exhaust pipe proximal end portion 15*f* which extends just rightward and is connected by fitting to the gas return port 15B in a horizontal posture; an exhaust pipe distal end portion 15*k* which extends just rearward and is connected by fitting to the gas outlet 15A in a horizontal posture; and an exhaust pipe intermediate portion 15*t* which connects the exhaust pipe proximal end portion 15*f* and the exhaust pipe distal end portion 15*k* to each other in a vertical posture. Accordingly, when the exhaust-side supply/exhaust pipe 15 is viewed as a whole, the exhaust-side supply/exhaust pipe 15 is also arranged in a posture where the head cover 3 side is lower than the oil separator S side.

As shown in FIG. 3 to FIG. 5, and FIG. 11, the pair of supply/exhaust pipes 14 15 are arranged such that almost all portion except for the end portions on the oil separator side, that is, remaining portions except for the end portions on an oil separator side of the supply pipe distal end portion 14*k* and the exhaust pipe distal end portion 15*k* pass above the exhaust cover 26 (the exhaust manifold 25).

Further, a sheet-metal-made heat shielding plate 27 is disposed between the supply pipe proximal end portion 14*f*, the exhaust pipe proximal end portion 15*f* and the exhaust pipe intermediate portion 15*t*, that is, portions of the pair of supply/exhaust pipes 14, 15 relatively close to the exhaust cover 26 in the vertical direction and the exhaust cover 26 in the vertical direction.

As shown in FIG. 5 and FIG. 11, the heat shielding plate 27 has: a heat shielding body 27A; a partition plate portion 27B which is formed by upwardly bending a portion of the heat shielding body 27A; a front leg portion 27C and a rear leg portion 27D which respectively support front and rear portions of the heat shielding body 27A; a front mounting base 27E which is continuously formed with the front leg portion 27C; and a rear mounting base 27F which is continuously formed with the rear leg portion 27D.

The rear mounting base 27F has not only a function of supporting the rear leg portion 27D by being threadedly mounted on both the exhaust manifold 25 and the exhaust cover 26 but also a function as a shielding member which shields a space between the exhaust flange 25A and the head cover 3 in the opening portion 26*a* formed in the exhaust cover 26. In FIG. 3 and FIG. 4, the illustration of the heat shielding plate 27 is omitted.

The partition plate portion 27B is a member which can prevent radiant heat of an exhaust pipe (not shown in the drawing) which is mounted on the exhaust flange 25A and is led out upward from being excessively transferred to the supply/exhaust pipes 14, 15. The partition plate portion 27B is disposed in an inclined manner such that the partition plate portion 27B extends from a front right side to a rear left side as viewed in a plan view. The desired number of (one to three) communication holes 27*a* for adjusting a degree of heat shielding are formed in the heat shielding body 27A. With the provision of the heat shielding plate 27, radiant heat of the exhaust cover 26 flows rearward or rightward along the heat shielding plate 27 due to cooling air and hence, a hot-air convection preventing effect can be expected.

In this manner, the oil separator S is disposed at a higher position than the head cover 3 such that the head cover 3 side becomes lower than the oil separator S side in both of the pair of supply/exhaust pipes 14, 15. The oil separator S is also mounted on an exhaust side of the cylinder head 2.

At the time of stopping the engine or the like after an operation of a working machine, even when moisture contained in a blow-by gas exists in the oil separator S, a liquid component containing moisture flows through the supply/exhaust pipes 14, 15 and flows into the head cover 3 or flows into the crankcase 1B after passing through the oil return passage 17 and hence, there is at least no possibility that moisture stagnates in the oil separator S. Accordingly, even in an environment of extremely low temperature, for example, in an environment below the freezing point, it is possible to acquire an advantageous effect of restricting the occurrence of a drawback that moisture is frozen in the oil separator S so that the oil separator S is clogged.

Along with the stopping of the engine, a liquid component containing moisture which exists in the pair of supply/exhaust pipes 14, 15 moves to the head cover 3 due to the arrangement structure of the supply/exhaust pipes 14, 15 where the head cover side becomes lower than the separator side and hence, it is also possible to prevent the supply/exhaust pipes 14, 15 from being clogged due to freezing of moisture. In addition, the supply/exhaust pipes 14, 15 are warmed by elevation of radiant heat of the exhaust manifold from below the supply/exhaust pipes 14, 15 and hence, it is possible to acquire an advantageous effect that, even when slight freezing occurs in the supply/exhaust pipes 14, 15, ice melts early due to radiant heat of the exhaust manifold 25 which is rapidly warmed along with starting of the engine.

Figure 10:
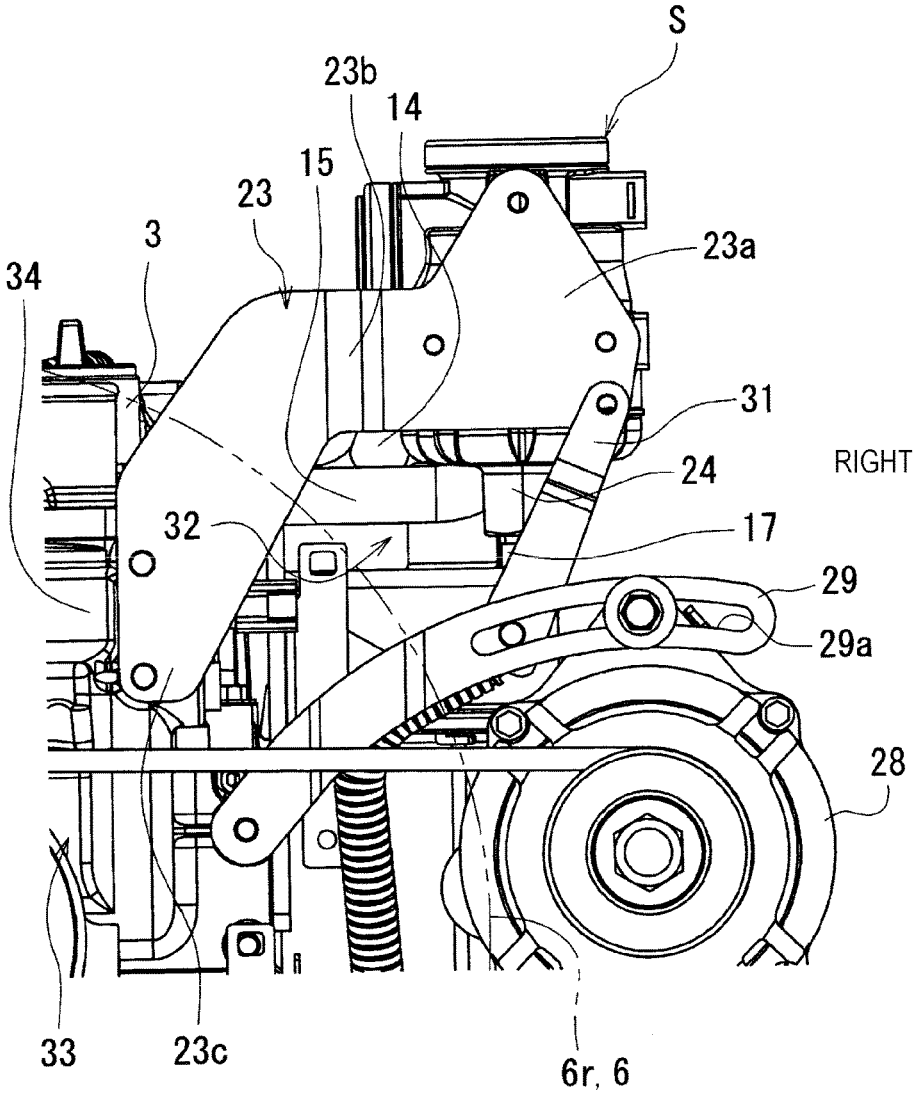
FIG. 10 is an enlarged front view of an oil separator portion.

As shown in FIG. 1 and FIG. 10, the oil separator S is disposed outside the rotational region 6*r* of the engine cooling fan 6 as viewed in the axis P direction (longitudinal direction) of the engine cooling fan 6 and is designed such that the oil separator S minimally receives a cooling action by cooling air. In addition, as shown in FIG. 3 to FIG. 5, the oil separator S disposed on a leeward side of the engine cooling fan 6 is disposed close to the engine cooling fan 6 in the axis P direction as much as possible and hence, the oil separator S can be disposed outside a region where cooling air spreads or outside of the region as much as possible. Accordingly, the oil separator S is disposed on an exhaust side in a state where the cooling air minimally impinges on the oil separator S and hence, it is possible to provide an engine which can efficiently prevent freezing of the oil separator S without deteriorating an engine cooling action.

The oil separator S is supported by the mounting bracket 23 in a cantilever manner and hence, there is a tendency for the oil separator S to be liable to vibrate (resonate or the like) due to vibrations of the engine. Accordingly, in this embodiment, the windproof portion 23*a* is connected and fixed to the adjusting arm 29 having a sufficient strength which is disposed below the oil separator S by way of the connecting member 31. Accordingly, it is possible to allow the mounting bracket 23 to have a structure substantially equal to the both-end support structure in a rational manner without using additional members thus obtaining an advantageous effect that the oil separator S can be supported with little vibration and with sufficient strength.

The oil separator S which is externally mounted on the engine is disposed on the exhaust manifold 25 side (right side of the engine E) with respect to the head cover 3, and has the windproof portion 23*a* which restricts impingement of cooling air. Accordingly, it is possible to provide the oil separator S which does not receive an air cooling action by cooling air but receives a radiant heat of exhaust air. That is, while the oil separator S has the externally-mounted structure which is advantageous for ensuring capacity and trapping of oil, the oil separator S is disposed in a temperature environment where freezing or the like minimally occurs as much as possible. The flowing passage 32 for cooling air is ensured below the oil separator S and hence, it is possible to acquire an advantageous effect that the engine can exhibit a sufficient cooling action as a whole while wind minimally impinges on the oil separator S.

As shown in FIG. 6, a blow-by gas in the crankcase 1B is made to return to a downstream side of the throttle valve 10 through the blow-by gas passage W consisting of the cutout portion 19, the cover one-end-side chamber (cover inner passage) 3A, the supply-side supply/exhaust pipe 14, the oil separator S, the exhaust-side supply/exhaust pipe 15, the proximal end portion of the cover other-end-side chamber 3B, the filter 16, distal end portion of the cover other-end-side chamber (cover inner passage) 3B, the PCV valve 12, the pipe 20 for blow-by gas, and the main pipe 9 (one example of the intake passage) in this order. Oil in a blow-by gas which is trapped by the filter 16 mounted on the cover is made to return to the inside of the crankcase 1B through the return passage not shown in the drawing.

The oil separator S which is mounted on an outer side of the engine E, that is, externally mounted on the engine E is provided as an independent component separately from the head cover 3 which includes the filter 16 in the inside thereof and hence, a sufficient volume of the blow-by gas passage W can be ensured in total and, at the same time, a filter area and a capacity of the oil separator S can be sufficiently ensured and hence, a liquid component in a blow-by gas mainly constituted of oil can be sufficiently removed. An arrangement place of the filter 16 in the head cover 3 can be variously changed and set, and also the filter 16 may be omitted.

The oil separator S is externally mounted on the engine E and hence, it is necessary to provide the partition wall 3W, the gas take-out port 14B, and the gas return port 15B. However, it is unnecessary to increase a size of the head cover 3 and to change a shape of the head cover 3 and hence, the blow-by gas return structure whose functions are strengthened can be realized economically and in a rational manner.

When a blow-by gas is made to return to a downstream side of the throttle valve 10 through the PCV valve 12, the main pipe 9 is brought into a negative pressure and hence, when the oil separator S is merely connected to the main pipe 9, there arises a drawback that oil mist is also made to return to the downstream side of the throttle valve 10 whereby, for example, it is necessary to take a countermeasure such as providing a check valve to the oil return passage 17 of the oil separator S.

However, by improving the structure such that the oil separator S is connected to an intermediate portion of the gas passage in the head cover 3 in a communicable manner by partitioning the inside of the head cover 3 in the longitudinal direction and the filter 16 which becomes an air flow resistance is provided to the cover other-end-side chamber 3B, a negative pressure in the main pipe 9 minimally acts on the oil separator S.

Accordingly, in the oil separator S, by merely connecting the oil return passage 17 to the bottom portion 24 without providing a check valve and the like, oil which is trapped in the inside of the oil separator S can be made to return to the crankcase 1B by free fall. The filter 16 provided to the inside of the head cover 3 is disposed on a downstream side of the oil separator S in the blow-by gas flowing direction and hence, the oil trapping filter 16 can function also as a resistor for canceling a negative pressure, thus providing an economical and rational blow-by gas return structure.

The pair of supply/exhaust pipes 14, 15 which makes the head cover 3 and the oil separator S communicate with each other is led out from the head cover 3 in the horizontal direction by providing the gas take-out port 14B and the gas return port 15B horizontally on the side wall 3S of the head cover 3. Accordingly, a space disposed on the lateral side of the engine E can be effectively used as a space for disposing the oil separator S and hence, there is an advantage that the oil separator S which contributes to the increase of the capacity can be mounted on the engine E without or almost without increasing a height size of the engine E.

Next, the structural improvement of a blow-by gas return portion of the pipe 20 to the intake passage 9 is described. As shown in FIG. 12 and FIG. 13, a temperature elevating mechanism T elevates a temperature of a blow-by gas inlet 9A of the intake passage 9. The temperature of the blow-by gas inlet 9A is provided for elevating a temperature of a blow-by gas which is made to return to the intake passage 9 through the pipe 20 from the PCV valve 12 which is a blow-by gas outlet of the head cover 3. The temperature elevating mechanism T is formed such that a cooling water transfer passage (hereinafter simply referred to as a transfer passage) 35 is formed in a portion of the blow-by gas inlet 9A of the intake passage 9.

Figure 12A:
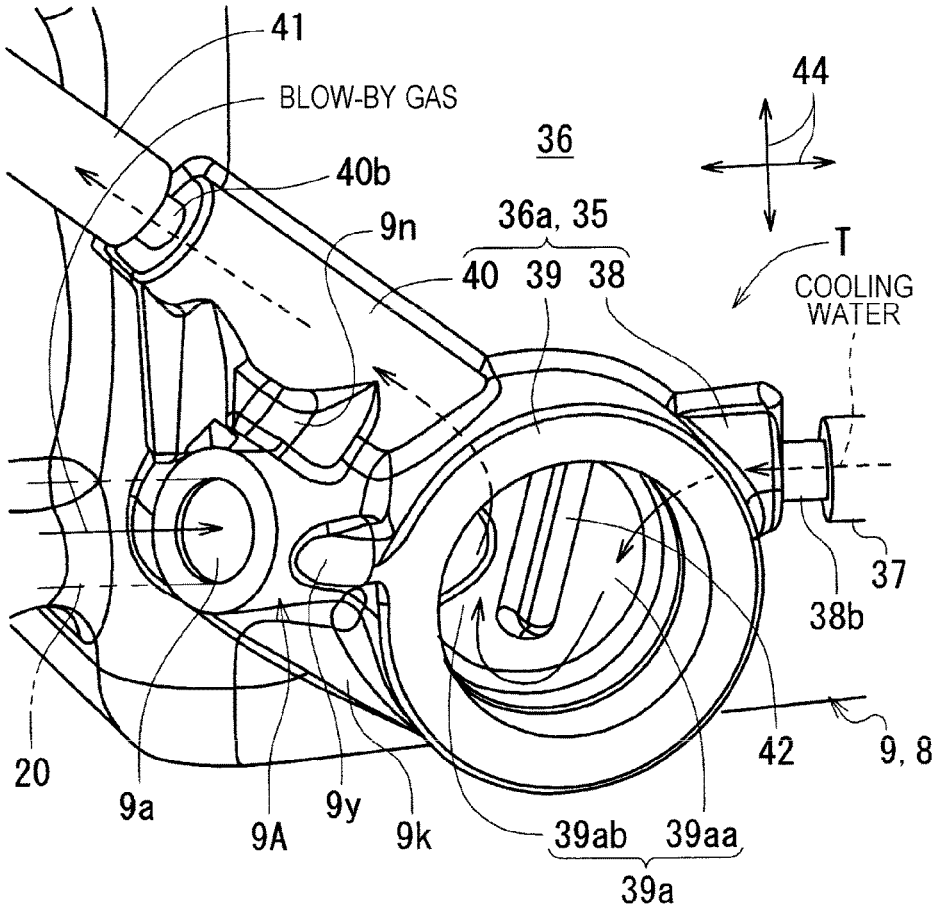
FIGS. 12A and 12B are views showing a blow-by gas temperature elevating mechanism.
Figure 12B:
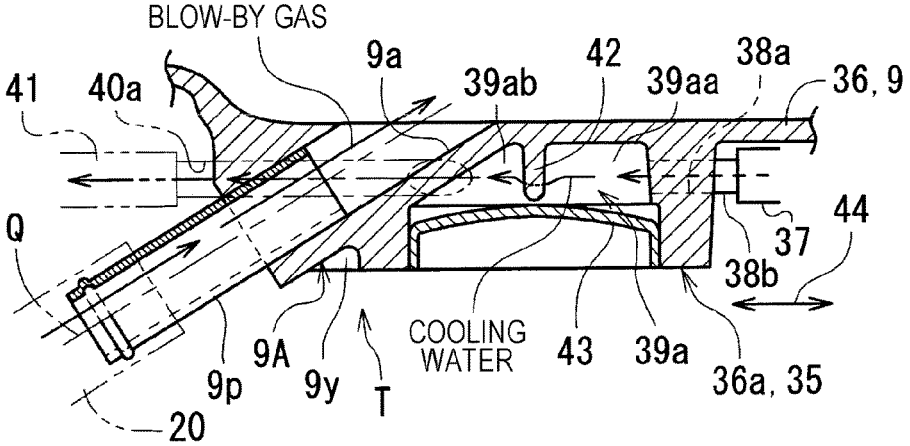
Figure 13:
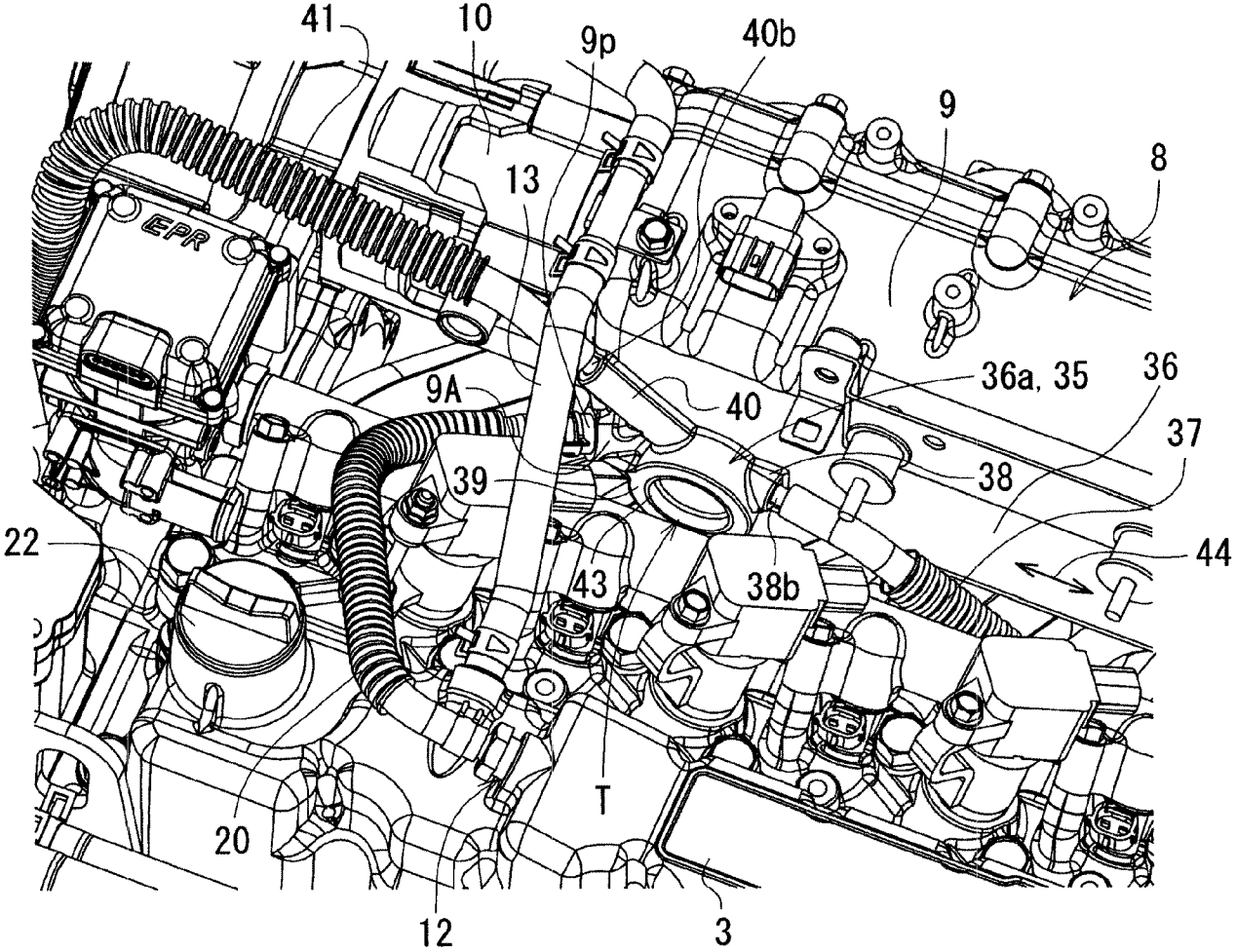
FIG. 13 is an enlarged view of a main part showing a temperature elevating mechanism and an area in the vicinity of the temperature elevating mechanism shown in FIG. 5.

As shown in FIG. 12A and FIG. 12B, the transfer passage (riser) 35 is formed in a wall outer side of a structural wall 36 which is a right (head cover 3 side) side wall of the main pipe 9. The blow-by gas inlet 9A having a communication hole 9*a* which is an inclined through hole having an axis Q thereof inclined with respect to an expanding direction 44 of the structural wall 36 is formed in the structural wall 36. A bulging wall portion 36*a* which has the transfer passage 35 is formed on the structural wall 36 in a state where the bulging wall portion 36*a* overlaps with a base portion of the inlet 9A.

The bulging wall portion 36*a* is formed of: a cooling water inlet portion 38 which is provided for connecting an upstream-side pipe 37 to the bulging wall portion 36*a* in a communicable manner thus allowing cooling water to flow into the bulging wall portion 36*a*; a cooling water main flow portion 39 which makes cooling water flowing into the bulging wall portion 36*a* from the upstream-side pipe 37 flow through in a routed-around manner; and a cooling water outlet portion 40 which is provided for connecting a downstream-side pipe 41 to the bulging wall portion 36*a* in a communicable manner thus allowing cooling water which flows from the cooling water main flow portion 39 to flow into the downstream-side pipe 41.

As shown in FIG. 12A and FIG. 12B, the cooling water main flow portion 39 is formed just behind the inlet 9A of the structural wall 36 by projecting the structural wall 36 in a laterally opened cylindrical shape in a state where the cooling water main flow portion 39 is integrally formed with the inlet 9A. The cooling water main flow portion 39 is sealed by a cup-shaped lid body 43. On the cooling water main flow portion 39, a partition wall 42 which projects downward and laterally (rightward) is formed such that the cooling water flow passage 39*a* disposed inside the cooling water main flow portion 39 forms a bypass passage through which cooling water flows downward once and then flows upward. That is, the flow passage 39*a* is formed of: a flow passage proximal end portion 39*aa* which is directed downward; and a flow passage distal end portion 39*ab* which is directed upward. In FIG. 12A, the lid body 43 is omitted.

As shown in FIG. 12A and FIG. 12B, the cooling water inlet portion 38 has: a flow passage 38*a* which opens at a rear upper portion of the cooling water main flow portion 39 and extends in the longitudinal direction; and a connecting pipe 38*b* which is press-fitted into the flow passage 38*a* so as to allow mounting by fitting of an upstream-side pipe 37 thereon. The cooling water outlet portion 40 has: a flow passage 40*a* which opens at a longitudinal upper portion of the cooling water main flow portion 39 and is directed obliquely in the longitudinal direction; and a connecting pipe 40*b* which is press-fitted into the flow passage 40*a* so as to allow mounting by fitting of a downstream-side pipe 41 thereon. The structural wall 36 is made of an aluminum alloy which is excellent in thermal conductivity. However, the structural wall 36 may be made of other metals.

Three ribs 9*k*, 9*y*, 9*n* are formed on the inlet 9A. That is, a lower rib 9*k* and a lateral rib 9*y* are formed between the inlet 9A and the cooling water main flow portion 39, and oblique ribs 9*n* are formed between the inlet 9A and the cooling water outlet portion 40. A connecting pipe 9*p* for connecting the pipe 20 for a blow-by gas to the inlet 9A on which the pipe 20 is mounted in a communicable manner by fitting is press-fitted into the communication hole 9*a*. That is, the transfer passage 35 is formed into a passage having a curved shape so as to follow an outer periphery of the communication hole 9*a* by the flow passage distal end portion 39*ab* of the cooling water main flow portion 39 and the flow passage 40*a* of the cooling water outlet portion 40.

As shown in FIG. 12A and FIG. 12B, cooling water which is warm water discharged from the cooling water pump 33 flows in a predetermined portion and, thereafter, a portion of the cooling water returns to the cooling water pump 33 after passing through the transfer passage 35 of the intake manifold 8, the downstream-side pipe 41 and the like from the upstream-side pipe 37. The transfer passage 35 is formed in the structural wall 36 together with the blow-by gas inlet 9A so as to surround the distal end portion of the pipe 20 for a blow-by gas, that is, to surround the blow-by gas inlet 9A of the intake passage 9. In the cooling water main flow portion 39, the flow of cooling water is made to meander by the partition wall 42. With such a configuration, the flow passage distal end portion 39*ab* which extends along the outer periphery of the blow-by gas inlet 9A is formed. In addition, the flow passage 40*a* which extends along the outer periphery of the blow-by gas inlet 9A is formed also by the cooling water outlet portion 40 which makes cooling water to flow obliquely upward and frontward.

With the provision of the temperature elevating mechanism T having the above-mentioned configuration, heat of cooling water which flows in the transfer passage 35 is transferred through the bulging wall portion 36*a*, more specifically, the cooling water main flow portion 39, the cooling water outlet portion 40, the lower rib 9*k*, the lateral rib 9*y*, and the oblique rib 9*n* and hence, the blow-by gas inlet 9A is efficiently warmed. Accordingly, even when moisture in a blow-by gas which flows in the pipe 20 is frozen under an extremely low temperature condition such as −30° C. or the like, along with temperature elevation of cooling water brought about by starting of the engine, a distal end portion of the pipe 20 is rapidly warmed so that a temperature of the blow-by gas inlet 9A, that is, a temperature of a blow-by gas which flows the communication hole 9*a* can be effectively elevated. Accordingly, the blow-by gas return structure is structurally improved such that a state is brought about where freezing minimally occurs in the blow-bay gas passage formed of the pipe 20 disposed outside the engine thus minimizing the occurrence of a drawback caused by freezing at a low temperature.

That is, the temperature elevating mechanism T is a unit for supplying warm water to an area in the vicinity of a portion which is liable to be subjected to icing at a merging portion in the intake passage 9 for a blow-by gas thus preventing or avoiding such icing by local warming. Even when the riser (transfer passage 35) has a small capacity, to enable the riser to efficiently warm a blow-by gas, the flow of warm water (cooling water) is restricted by the partition wall 42 thus forming a passage having a bent shape in the riser (cooling water main flow portion 39). Further, with the provision of various ribs, that is, the lower rib 9*k*, the lateral rib 9*y*, and the oblique rib 9*n*, thermal conductivity is further enhanced.

As a result, due to such structural improvement, a state is brought about where freezing minimally occurs in an intake-passage-side end portion of the blow-by gas passage such as the pipe disposed outside the engine. Accordingly, it is possible to provide the improved blow-by gas return structure which can minimize the malfunction of a blow-by gas return function caused due to freezing at a low temperature and the occurrence of unexpected leakage of oil caused due to clogging of the passage.

The blow-by gas return structure of the present invention also has the following technical features (1) to (6).

(1) The temperature elevating mechanism T is configured such that the cooling water transfer passage 35 is formed in a portion of the blow-by gas inlet 9A of the intake passage 9.

In this manner, the temperature elevating mechanism is provided by forming the cooling water transfer passage at a portion of the blow-by gas inlet of the intake passage and hence, the temperature elevating mechanism can exhibit a function of preventing freezing of the pipe outlet portion during the operation of the engine and a function of rapidly defrosting the pipe outlet portion at the time of starting the engine by making effective use of the engine heat using cooling water.

As a result, the temperature elevating mechanism which warms the blow-by gas inlet of the intake passage is realized by the rational structural improvement which makes use of the engine heat thus obtaining an advantage that the above-mentioned advantageous effects (minimizing the malfunction of a blow-by gas return function and the occurrence of unexpected leakage of oil due to clogging) can be realized economically and in a rational manner.

(2) The intake passage 9 is formed of the intake manifold 8, the blow-by gas inlet 9A has the communication hole 9*a* which penetrates the structural wall 36 forming the intake manifold 8 such that the communication hole 9*a* opens to the inside and the outside of the structural wall, and the transfer passage 35 is formed on the wall outer side of the structural wall 36.

In this manner, the blow-by gas inlet and the cooling water transfer passage are formed on the wall outer side of the structural wall of the intake manifold, and the transfer passage can be formed in the indispensable constitutional parts and hence, there is an advantage that it is possible to realize the temperature elevating mechanism which makes use of the engine heat while realizing the reduction of the number of parts and suppressing the increase of a cost without narrowing the intake passage.

(3) The communication hole 9*a* is formed as an inclined through hole having the axis Q which is inclined with respect to the wall expanding direction of the structural wall 36.

In this manner, the communication hole is formed as the inclined through hole which is inclined with respect to the wall expanding direction of the structural wall and hence, compared to a case where the communication hole is a hole which is orthogonal to the wall expanding direction, there is an advantage that a heat receiving volume of the structural wall can be increased without causing any problems thus contributing to the improvement of thermal conductivity.

(4) The transfer passage 35 is formed into a passage having a curved shape so as to follow the outer periphery of the communication hole 9*a*.

In this manner, the transfer passage is formed into a passage having a curved shape along the outer periphery of the communication hole and hence, there is an advantage that the thermal conductivity can be further enhanced.

(5) The structural wall 36 in which the communication hole 9*a* and the transfer passage 35 are formed is a side wall of the main pipe 9 from which the plurality of branch pipes 30 extending toward the respective cylinders of the intake manifold 8 are branched.

In this manner, the structural wall having the transfer passage is the side wall of the main pipe from which the plurality of branch pipes extending toward the respective cylinders are branched and hence, compared to a case where a blow-by gas is made to return to the branch pipes, an action of elevating a temperature of a blow-by gas can be acquired while making a blow-by gas return to the respective cylinders uniformly without causing non-uniform distribution of a blow-by gas into the respective cylinders.

(6) The main pipe 9 is formed of a molded product made of an aluminum alloy.

In this manner, the structural wall is made of an aluminum alloy so that there is an advantage that the structural wall can possess excellent thermal conductivity also from a viewpoint of a material.

Another Embodiment

The configuration may be adopted where the transfer passage 35 surrounds the blow-by gas inlet 9A by a half turn or by one turn so that heat conduction is improved. The configuration may be also adopted where a cross-sectional area of the communication hole 9*a* is increased so that heat conduction is improved. The temperature elevating mechanism T may be disposed on an upper wall of the main pipe 9.

What is claimed is:

1. A blow-by gas return structure configured such that a blow-by gas in a crankcase is introduced into an intake passage through a cover inner passage formed in a head cover, the blow-by gas return structure comprising:

a pipe which connects a blow-by gas outlet of the head cover and a blow-by gas inlet of the intake passage in a communicable manner; and a temperature elevating mechanism configured to elevate a temperature of the blow-by gas inlet.

2. The blow-by gas return structure according to claim 1, wherein the temperature elevating mechanism is configured such that a cooling water transfer passage is formed in a portion of the blow-by gas inlet of the intake passage.

3. The blow-by gas return structure according to claim 2, wherein the intake passage is an intake manifold, the blow-by gas inlet has a communication hole which penetrates a structural wall forming the intake manifold such that the communication hole opens to the inside and the outside of the structural wall, and the transfer passage is formed on a wall outer side of the structural wall.

4. The blow-by gas return structure according to claim 3, wherein the communication hole is formed as an inclined through hole having an axis which is inclined with respect to a wall expanding direction of the structural wall.

5. The blow-by gas return structure according to claim 3, wherein the transfer passage is formed into a passage having a curved shape so as to follow an outer periphery of the communication hole.

6. The blow-by gas return structure according to claim 4, wherein the transfer passage is formed into a passage having a curved shape so as to follow an outer periphery of the communication hole.

7. The blow-by gas return structure according to claim 3, wherein the structural wall in which the communication hole and the transfer passage are formed is a side wall of a main pipe from which a plurality of branch pipes extending toward respective cylinders of the intake manifold are branched.

8. The blow-by gas return structure according to claim 4, wherein the structural wall in which the communication hole and the transfer passage are formed is a side wall of a main pipe from which a plurality of branch pipes extending toward respective cylinders of the intake manifold are branched.

9. The blow-by gas return structure according to claim 5, wherein the structural wall in which the communication hole and the transfer passage are formed is a side wall of a main pipe from which a plurality of branch pipes extending toward respective cylinders of the intake manifold are branched.

10. The blow-by gas return structure according to claim 6, wherein the structural wall in which the communication hole and the transfer passage are formed is a side wall of a main pipe from which a plurality of branch pipes extending toward respective cylinders of the intake manifold are branched.

11. The blow-by gas return structure according to claim 7, wherein the main pipe is formed of a molded product made of an aluminum alloy.

12. The blow-by gas return structure according to claim 8, wherein the main pipe is formed of a molded product made of an aluminum alloy.

13. The blow-by gas return structure according to claim 9, wherein the main pipe is formed of a molded product made of an aluminum alloy.

14. The blow-by gas return structure according to claim 10, wherein the main pipe is formed of a molded product made of an aluminum alloy.

* * * * *